US007428928B2

(12) United States Patent
Cho et al.

(10) Patent No.: US 7,428,928 B2
(45) Date of Patent: Sep. 30, 2008

(54) SEALING SPRING MECHANISM FOR A SUBTERRANEAN WELL

(75) Inventors: Brian W. Cho, Sugar Land, TX (US); Rodney J. Wetzel, Katy, TX (US); Rashmi Bhavsar, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 490 days.

(21) Appl. No.: 10/708,973

(22) Filed: Apr. 5, 2004

(65) Prior Publication Data

US 2005/0217850 A1 Oct. 6, 2005

(51) Int. Cl.
*E21D 33/12* (2006.01)

(52) U.S. Cl. ..... 166/285; 166/386; 166/135; 166/192; 166/173

(58) Field of Classification Search ..... 166/285, 166/386, 387, 381, 118, 231, 135, 192, 241.6, 166/241.7, 207, 173, 151, 188; 175/325.1–325.7; 267/69–74, 166–180
See application file for complete search history.

(56) References Cited

U.S. PATENT DOCUMENTS 1,459,368 A * 6/1923 Henshaw et al. ..... 166/151
2,325,556 A 7/1943 Taylor et al.
2,872,230 A 2/1959 Desbrandes
3,066,739 A * 12/1962 Saurenman et al. ..... 166/188
3,067,819 A * 12/1962 Gore ..... 166/387
3,136,365 A 6/1964 Carter et al.
3,314,479 A * 4/1967 McCullough et al. ..... 166/135
4,501,327 A * 2/1985 Retz ..... 166/285
4,671,354 A 6/1987 Henderson et al.
5,335,723 A * 8/1994 Mouton ..... 166/173
6,296,054 B1 10/2001 Kunz

FOREIGN PATENT DOCUMENTS

RU 2232254 C2 7/2004
WO 99/10622 A1 3/1999

* cited by examiner

*Primary Examiner*—Richard E. Chilcot, Jr.
*Assistant Examiner*—Matthew J Smith
(74) *Attorney, Agent, or Firm*—Fred G. Pruner; Daryl R. Wright; Bryan P. Galloway

(57) ABSTRACT

A technique includes deploying a spring downhole, energizing the spring and using the energized spring to form an annular barrier in the well. The spring may be energized prior to being run downhole or after being run downhole, depending on the particular embodiment of the invention.

35 Claims, 9 Drawing Sheets

SEALING SPRING MECHANISM FOR A SUBTERRANEAN WELL

BACKGROUND OF INVENTION

The invention generally relates to a sealing mechanism for a subterranean well.

For such purposes as producing fluid from and testing a subterranean well, a device called a packer may be used. The packer typically is run downhole on a tubular string. The packer, when set, forms an annular barrier in a region (typically called the "annulus") between the string and a wellbore wall or a casing wall, depending on whether the well is cased.

A typical packer includes an annular elastomer sealing ring that is exposed on the outside of the packer and is concentric with the longitudinal axis of the string. When run downhole, the elastomer ring is uncompressed, a state that minimizes the outer diameter of the ring. When the packer is to be set, sleeves (hydraulically or mechanically activated sleeves, for example) compress the elastomer sealing ring so that the ring radially expands to seal off the annulus.

The above-described conventional packer typically is optimized to form a seal between a string and the inside of a casing wall. However, challenges may arise in sealing off the annulus in an uncased well. More specifically, the wellbore wall that defines the surface to which a seal must be formed typically has an irregular profile, and the elastomer sealing ring typically has a relatively uniform radius of expansion. Therefore, it may be challenging to form a seal between the elastomer sealing ring and an irregularly-shaped borehole wall.

Thus, there is a continuing need for better ways to seal off the annulus in an uncased well. There is also a continuing need for better ways to seal off the annulus in a cased well.

SUMMARY OF INVENTION

In an embodiment of the invention, a technique includes deploying a spring downhole, energizing the spring and using the energized spring to form an annular barrier in the well. The spring may be energized prior to being run downhole or after being run downhole, depending on the particular embodiment of the invention.

Advantages and other features of the invention will become apparent from the following description, drawing and claims.

DETAILED DESCRIPTION

Figure 1:
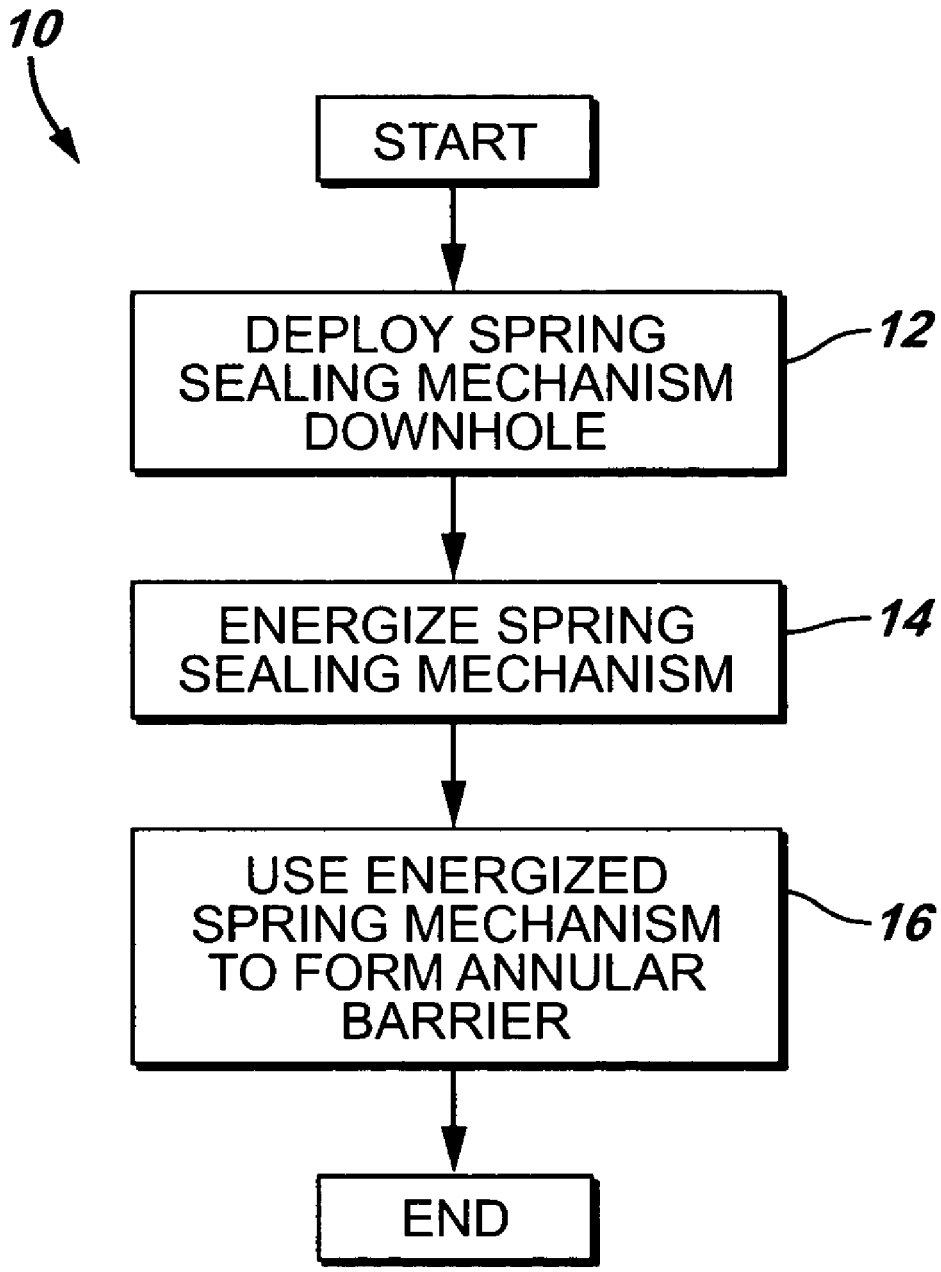
FIGS. 1, 10, 11 and 14 are flow diagrams depicting techniques to form an annular barrier in a subterranean well according to different embodiments of the invention.

Referring to FIG. 1, in accordance with an embodiment 10 of the invention, a technique includes using a spring-based sealing mechanism (herein called the "spring sealing mechanism") to form an annular barrier in a subterranean well. More specifically, the technique 10 includes deploying (block 12) a spring sealing mechanism downhole and energizing (block 14) the spring sealing mechanism. As described further below, the energizing of the spring sealing mechanism may occur either before or after the spring sealing mechanism is run downhole, depending on the particular embodiment of the invention. Regardless of where the spring sealing mechanism is energized, the energized spring sealing mechanism is used to form an annular barrier in the subterranean well, as depicted in block 16.

Figure 2:
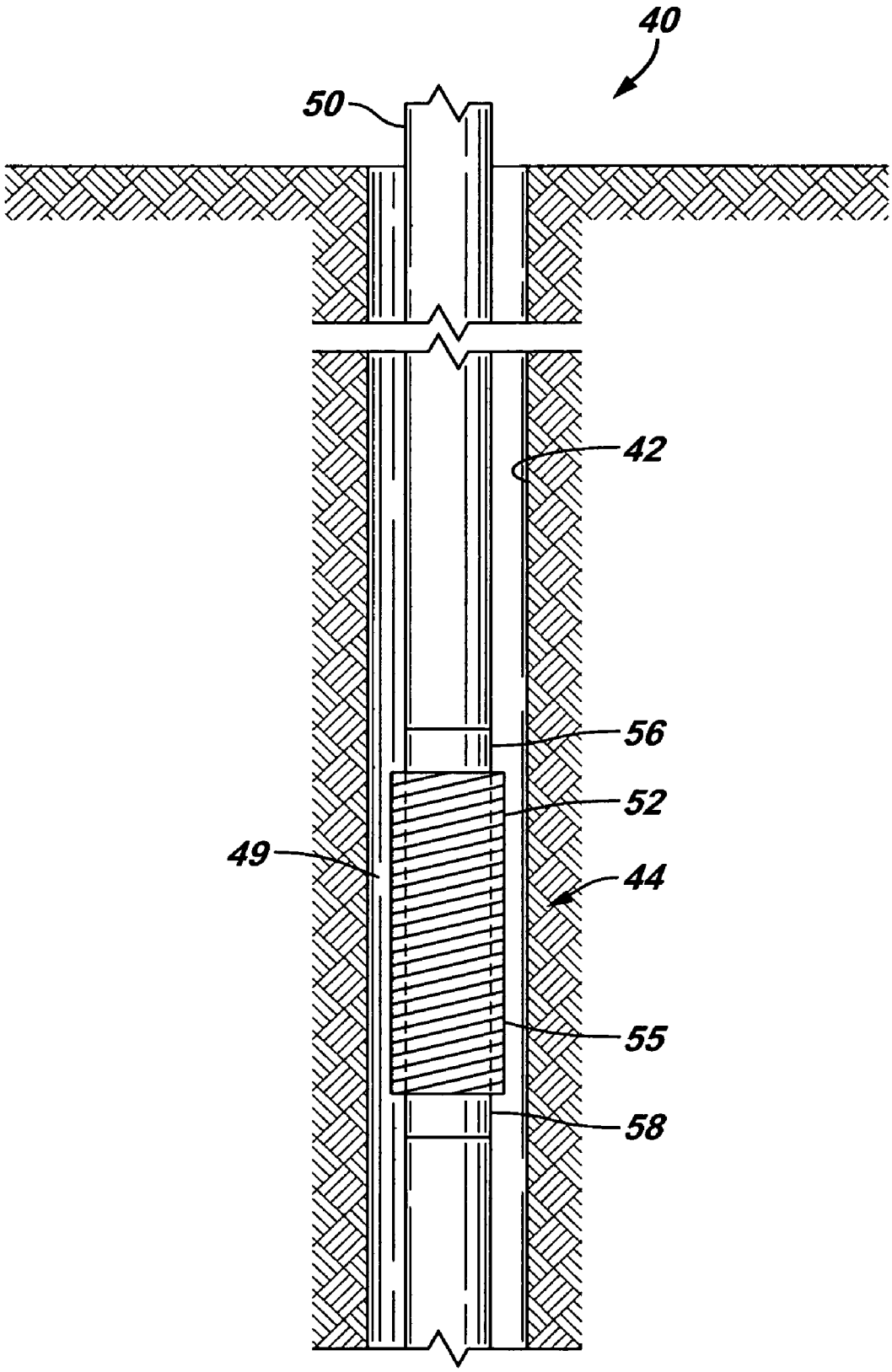
FIG. 2 is a schematic diagram of a subterranean well depicting a spring sealing mechanism in an unexpanded state according to an embodiment of the invention.

FIG. 2 depicts a subterranean well 40 to further illustrate application of the technique 10. Referring to FIG. 2, the subterranean well 40 includes a wellbore 42 that extends through one or more subterranean formations. Although the wellbore 42 is depicted in FIG. 2 as being a vertical wellbore, the wellbore 42 may be a lateral wellbore, in other embodiments of the invention. The wellbore 42 is also depicted in FIG. 2 as being uncased. However, the wellbore 42 may be cased or uncased, depending on the particular embodiment of the invention.

The subterranean well 40 includes a tubular string 50 that is inserted into the wellbore 42 for purposes of performing a particular function, such as a function relating to production, injection or testing, as examples. Pursuant to this function, it may be desirable to form an annular barrier in a particular segment 44 of the wellbore 42. More specifically, this annular barrier may be formed between the exterior of the string 50 and the wall of the wellbore 42 to seal off an annulus 49 of the well 40.

For purposes of forming this annular barrier, the string 50 may include a sealing tool 55, a tool that includes a spring sealing mechanism 52 in accordance with the technique 10 (FIG. 1). The spring sealing mechanism 52, when energized, expands to form a seal between the string 50 and the wall of the wellbore 42.

Figure 3:
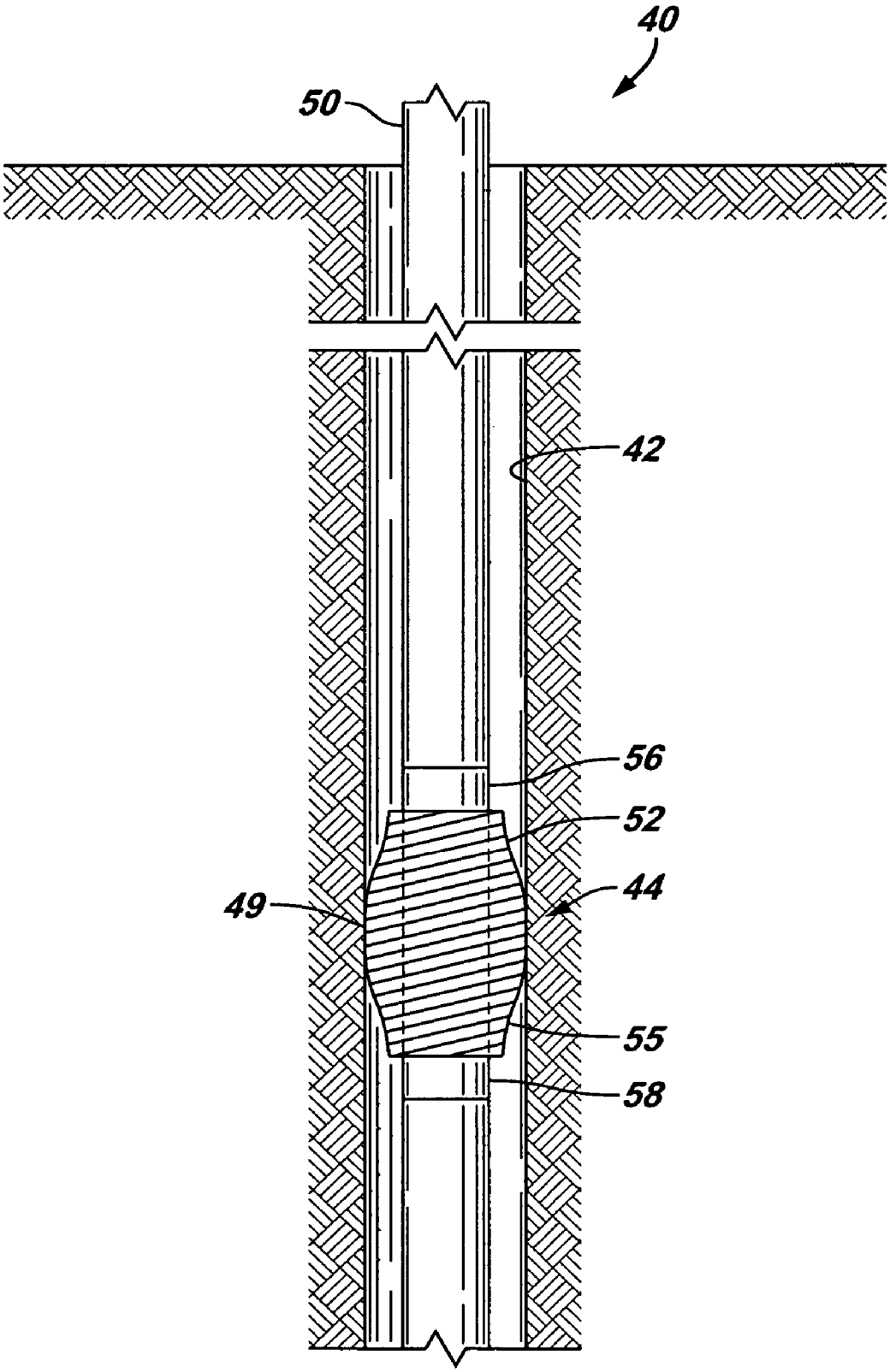
FIG. 3 is a schematic diagram of the well depicting the spring sealing mechanism in an expanded state according to an embodiment of the invention.

More particularly, in some embodiments of the invention, the sealing tool 55 may include mechanically or hydraulically-activated pistons (not shown) that move upper 56 and lower 58 sleeves of the sealing tool 55 to compress the spring sealing mechanism 52 to cause radial expansion of the mechanism 52, as depicted in FIG. 3. As further described below, in this expanded state, the spring sealing mechanism 52 provides an annular barrier to seal off the region between the string 50 and the wall of the wellbore 42.

As described further below, the spring sealing mechanism 52 establishes a mechanical structure that rigidly opposes radial contraction and is biased to expand to accommodate irregularities in the surface of the wellbore wall. Thus, the spring sealing mechanism 52 forms seals with irregularly-shaped, uncased borehole walls and accommodates the situation in which a portion of the wellbore wall may change after the initial setting of the mechanism 52.

Figure 4:
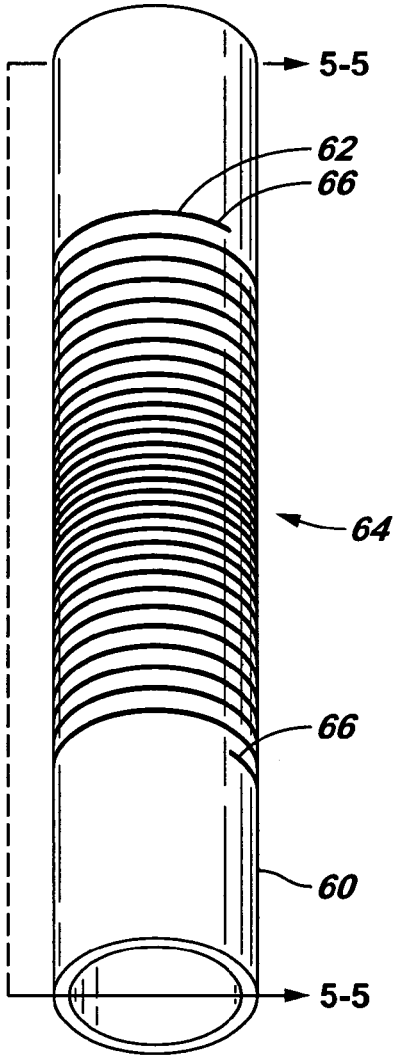
FIG. 4 is a perspective view of a spring of the spring sealing mechanism according to an embodiment of the invention.

The spring sealing mechanism includes a spring that is energized for purposes of forming the annular barrier. FIG. 4 depicts a perspective view of such a spring 54. The spring 54 may be a coil spring (or metal coil spring, for example) in accordance with some embodiments of the invention. As depicted in FIG. 4, the spring 54 may be generally formed from a tubular member 60 that is concentric with the string 50 and includes a helical groove 62 that is cut into the tubular member 60. The helical groove 62 spirally extends around the longitudinal axis of the tubular member 60.

In some embodiments of the invention, the density of the windings of the groove 62 (i.e., the number of windings per unit of longitudinal length) are not constant, but rather, the density of the windings may vary with longitudinal position along the tubular member 60. Stated differently, the tangential angle of the helical groove 62 is not constant, but rather, the tangential angle may vary along the length of the spring 54.

Figure 5:
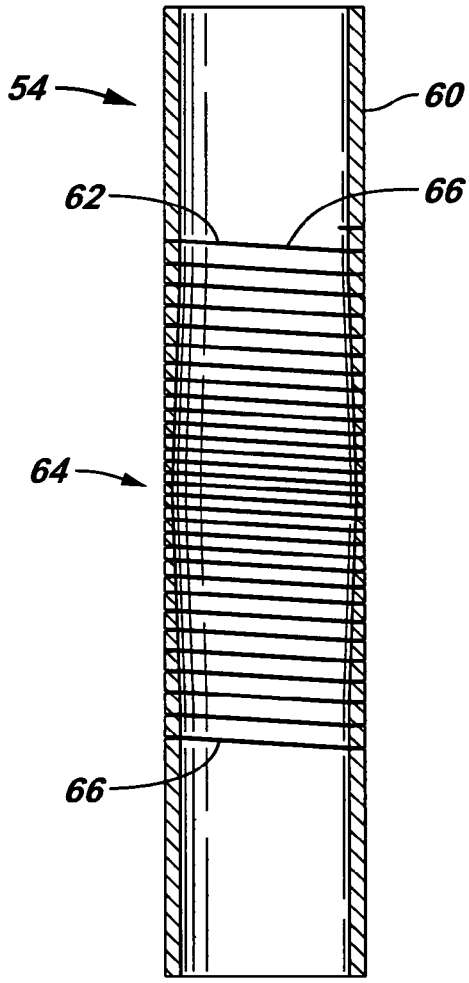
FIG. 5 is a cross-sectional view taken along lines 5-5 of FIG. 4 according to an embodiment of the invention.

For example, as depicted in FIG. 4, in some embodiments of the invention, the tangential angle of the helical groove 62 may be more shallow around a longitudinal midpoint 64 of the winding 62, and thus, more windings may be present near the midpoint 64, as the more shallow angle produces a greater concentration of windings near the midpoint 64. This increased density of windings near the midpoint 64 (as compared to the ends 66 of the groove 62), depicted in more detail in a cross-sectional view in FIG. 5, conditions the spring 54 to expand outwardly near the midpoint 64.

In some embodiments of the invention, the spring 54 may have other features to bias the spring 54 to bulge outwardly near the midpoint 64. For example, referring to FIG. 5, in some embodiments of the invention, the tubular member 60 may have a wall thickness that varies along the length of the member 60. More particularly, in some embodiments of the invention, the thickness of the wall of the tubular member 60 may be increasingly more narrow from the end 66 of the groove 62 toward the midpoint 64. Thus, the wall of the tubular member 60 has its minimum thickness at the midpoint 64 to bias the spring 54 to expand in a radially outward direction near the midpoint 64.

Figure 6:
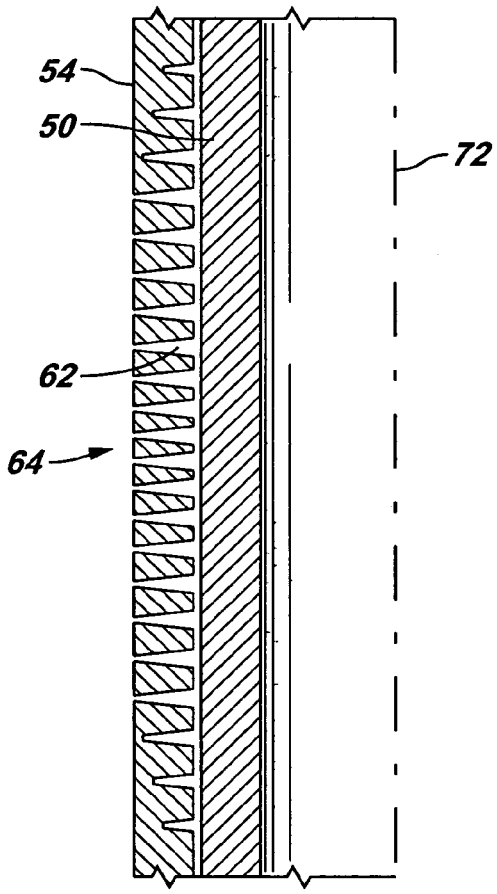
FIG. 6 is a more detailed cross-sectional view of a portion of the spring in an expanded state according to an embodiment of the invention.

FIG. 6 depicts a cross-section of the spring sealing mechanism (in accordance with some embodiments of the invention) showing a portion of the spring 54 surrounding a portion of the tubular string 50. Reference numeral 72 identifies the longitudinal axis of the sealing mechanism. Referring to FIG. 6, in some embodiments of the invention, the groove 62 may generally have a trapezoidal cross-section. As depicted in FIG. 6, in some embodiments of the invention, the groove 62 may be cut so that the portion of the groove 62 closest to the exterior surface of the tubular member 60 is more narrow, and the portion of the groove 62 closest to the inner diameter of the tubular member 60 is relatively wider. Due to this arrangement, the relatively larger width of the groove 62 near the inner diameter of the tubular member 60 allows space for expansion to facilitate bowing of the spring 54.

Additionally, as depicted in FIG. 6, in some embodiments of the invention, the depth of the groove 62 varies longitudinally. More specifically, near the midpoint 64, the groove has its maximum depth, extending through the wall of the tubular member 60; and near the ends 66, the groove 62 is relatively more shallow. This progressive deepening of the groove 62 from each end 66 to the midpoint 64 facilitates bending of the spring 54 near the midpoint 64.

Figure 7:
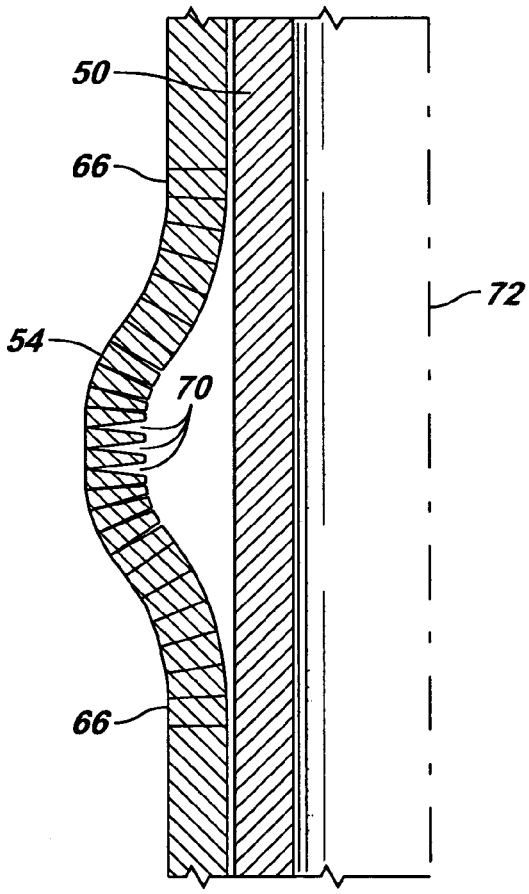
FIG. 7 is a more detailed cross-sectional diagram of the spring in an expanded state according to an embodiment of the invention.

Thus, referring to FIG. 7, when the spring 54 is energized and allowed to expand, the spring 54 expands to bow in a radially outward direction near the midpoint 64. As depicted in FIG. 7, near the midpoint 64, particular windings of the groove 62 have open spaces 70 on the inside of the tubular member 60, as compared to the windings of the groove 62 closer to the ends 66.

Figure 8:
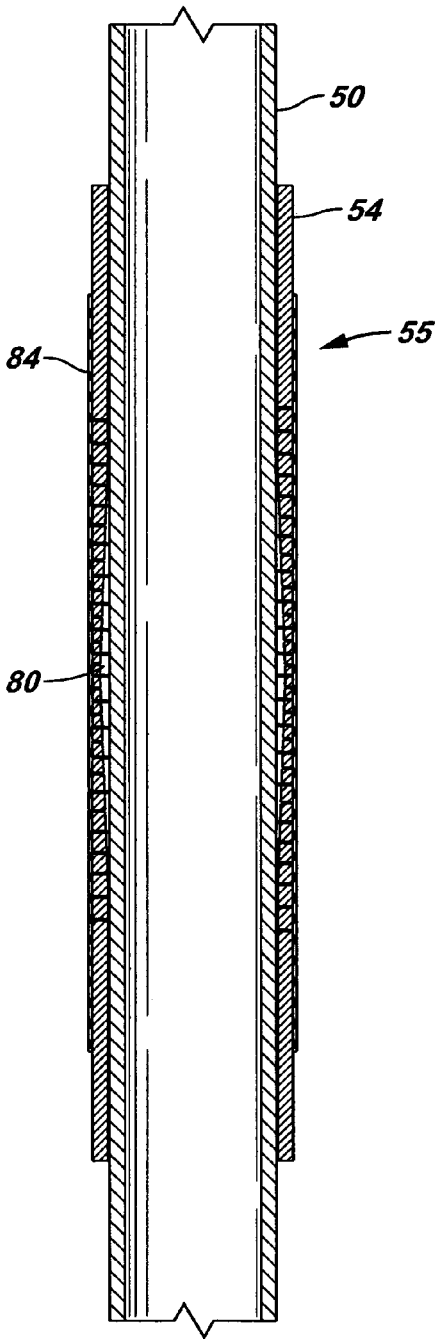
FIG. 8 is a cross-sectional view of a spring sealing mechanism according to an embodiment of the invention.

FIG. 8 depicts a spring sealing mechanism 55 in accordance with a particular embodiment of the invention. The spring sealing mechanism 55 circumscribes the tubular string 50, is concentric with the string 50 and includes the spring 54 that closely circumscribes the string 50. An elastomer sleeve 84 is also concentric with the string 50 and circumscribes the spring 54 to form a fluid seal with the wellbore wall, in some embodiments of the invention.

In some embodiments of the invention, the sealing mechanism 55 also includes a wedge 80 that generally circumscribes the string 50 and is concentric with the tubular string 50. The wedge 80 is located between the tubular member 50 and the spring 54. More specifically, the wedge 80 generally has a cylindrical shape and has a smaller axial length than the spring 54 and is located near the midpoint 64 of the spring 54.

Figure 9:
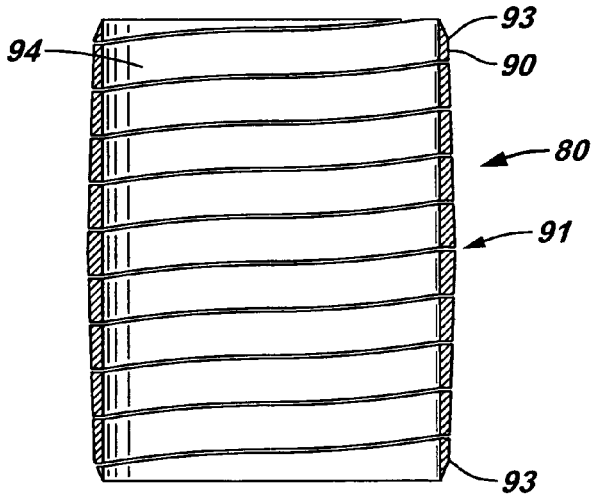
FIG. 9 is a cross-sectional view of a wedge of the spring sealing mechanism of FIG. 8 according to an embodiment of the invention.

Referring to FIG. 9, the wedge 80 includes a helical groove 84 that is cut into a tubular member 90 of the wedge 80 to form a spring. As depicted in FIG. 9, unlike the spring 54, the wedge 80 is formed from a tubular member 90 whose wall thickness progressively increases from each end 93 of a helical groove 94 of the tubular member 90 to a midpoint 91 of the groove 94. In some embodiments of the invention, the helical groove 94 winds around the tubular member 90 in an opposite direction from the winding of the spring 54. The combination of the groove 94 and the taper in the wall of the member 90 form a radial expansion force that acts on the spring 54 to force the spring 54 in a radially outward direction.

The spring 54 may be energized either before the spring sealing mechanism is run downhole or after the spring sealing mechanism is run downhole, depending on the particular embodiment of the invention. Thus, as depicted in FIGS. 2 and 3, in some embodiments of the invention, the spring 54 may be energized after the spring sealing mechanism is run downhole. However, referring to FIG. 10, in other embodiments of the invention, the spring 54 may be energized before the spring sealing mechanism (and thus, the spring) is run downhole.

Figure 10:
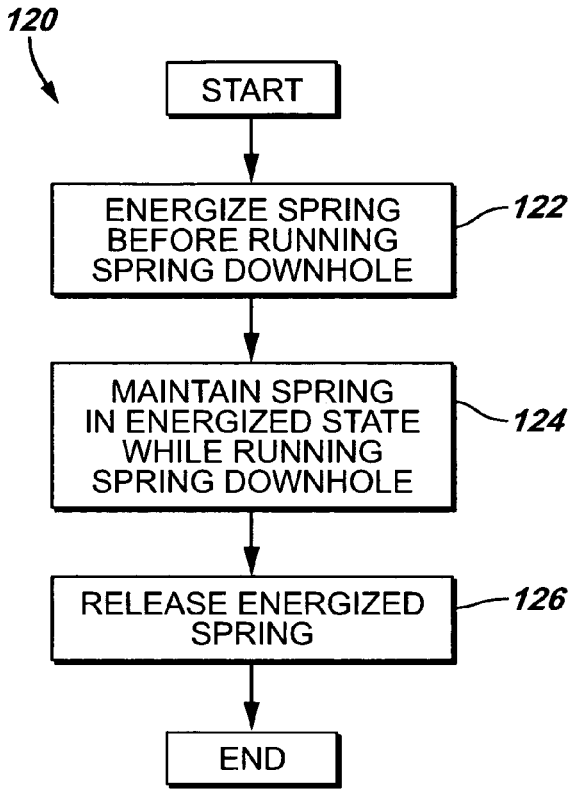

More specifically, FIG. 10 depicts a technique 120 in which the spring 54 is energized before the spring 54 is run downhole, as depicted in block 122. The spring 54 is then maintained in an energized state while the spring is run downhole, as depicted in block 124. After the spring 54 (and thus, the sealing tool 55) is in its appropriate position, the energized spring 54 is then released (to form the annular barrier), as depicted in block 126.

Among the potential advantages of the technique 120, the profile of the spring may be kept to a minimum while the spring 54 is run downhole and relatively complex mechanisms are not required downhole to energize the spring. Instead, the sealing tool may include a release mechanism (including collet fingers, for example) to hold the spring 54 in its energized state. As a more specific example, the release mechanism may include a sleeve in that each end of the spring may be held in place by an associated sleeve that is prevented from rotating. When the spring sealing mechanism is in place to be set, the rotational hold on one of the sleeves may then be released to allow the spring to expand. Many other variations are possible. The release mechanism may be remotely operated (operated by pressure pulses, mechanical motion or hydraulic pressure, as a few examples) to release the spring 54 from its energized state when the spring 54 is in the appropriate position.

Figure 11:
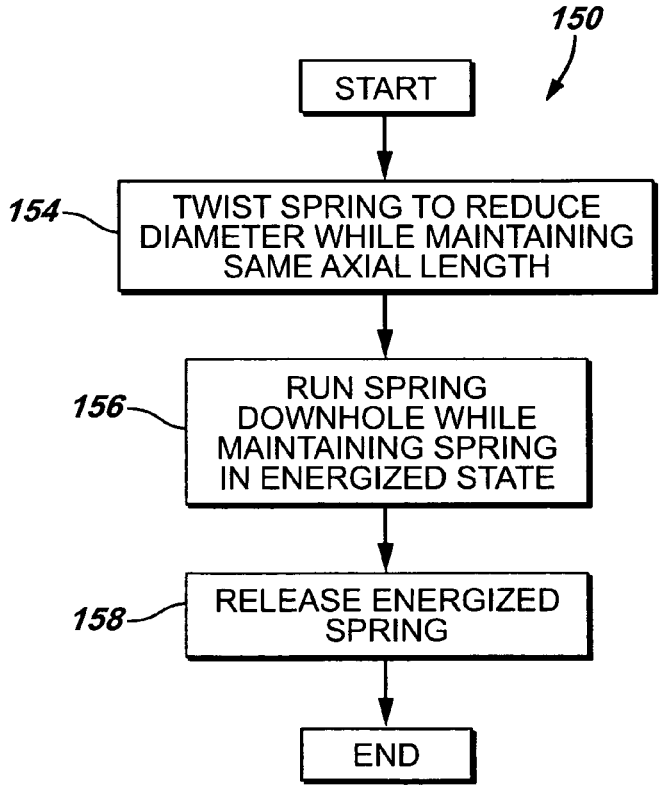

Referring to FIG. 11, as a more specific example, a technique 150 in accordance with the invention is used to energize the spring 54 before the spring is run downhole. The technique 150 includes twisting (block 154) the spring 54 in a direction consistent with the helical orientation of the spring 54 to reduce a diameter of the spring 54 while maintaining the same axial length for the spring. Next, in accordance with the technique 150, the spring is run downhole while the spring is maintained in its energized state, in accordance with block 156. When the spring 54 (and thus, the sealing tool 55) is in its appropriate position, the spring 54 is then released, as depicted in block 158.

Figure 12:
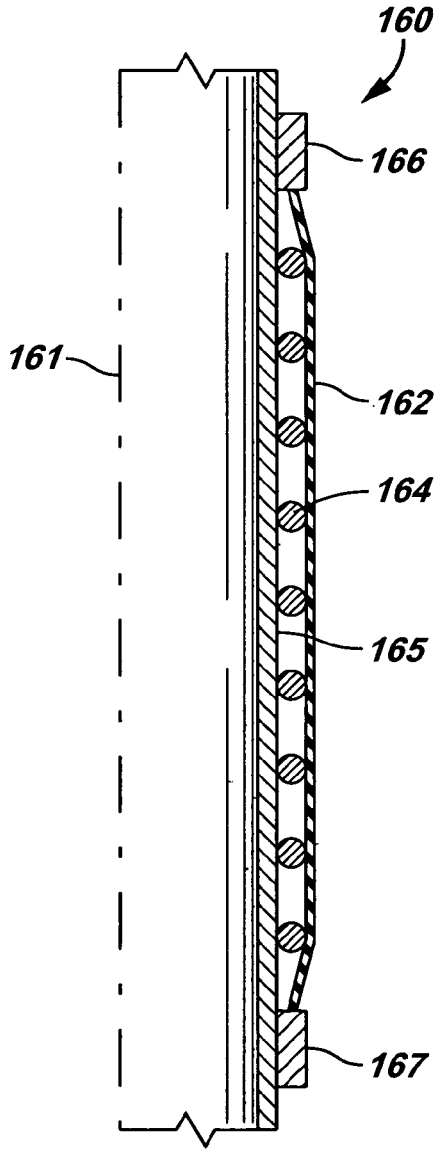
FIG. 12 is a schematic diagram depicting a spring sealing mechanism in an unexpanded state according to an embodiment of the invention.

Referring to FIG. 12, in some embodiments of the invention, the technique 150 may be used in accordance with a spring sealing mechanism 160. The spring sealing mechanism 160 is depicted in FIG. 12 in an unexpanded state. As shown, the spring sealing mechanism 160 includes a tubular member, or base pipe 165, that is circumscribed by a spring 164. An elastomer sealing sleeve 162 circumscribes the spring 164 to form the annular barrier seal for the spring sealing mechanism 160. Thus, as depicted in FIG. 12, the base pipe 165, spring 164 and sealing sleeve 162 all share the same longitudinal axis 161 that, in turn, is concentric with the string (for example) that conveys the spring sealing mechanism 160 downhole.

The spring sealing mechanism 160 also includes upper 166 and lower 167 collars, each of which circumscribes the base pipe 165 and is concentric with the longitudinal axis 161. In some embodiments of the invention, the upper end of the sleeve 162 is attached to the upper collar 166, and the lower end of the sleeve 162 is connected to the lower collar 167. Thus, in some embodiments of the invention, the collars 166 and 167 may serve to extend the spring 164 in the longitudinal direction thereby compressing the spring 164 in the radial direction to hold the spring in an energized and unexpanded state for purposes of running the spring sealing mechanism 160 downhole. Either of the collars 166, 167 may be movable to enable such extension, with the movable collar(s) being lockable in the extended state (such as by a collet, ratchet, or dog).

Figure 13:
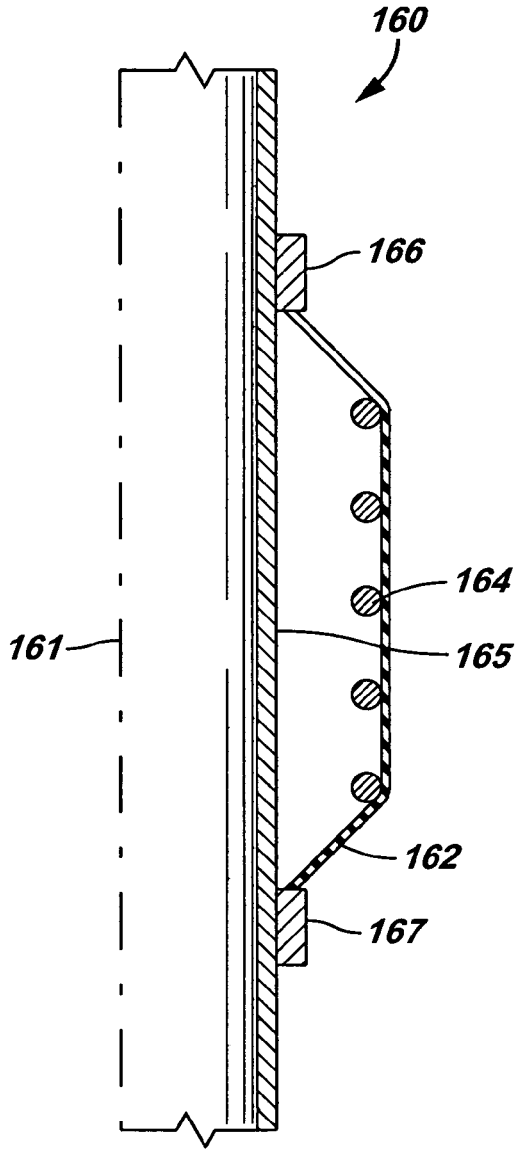
FIG. 13 is a schematic diagram of the spring sealing mechanism of FIG. 12 in an expanded state according to an embodiment of the invention.

When the spring sealing mechanism 160 is in position to be set within the well, the collars 166 and 167 may then be operated (unlocked) to allow the expansion of the spring 162, as depicted in FIG. 13. As shown, in this state and based on its spring properties, the spring 164 automatically compresses longitudinally and expands radially to extend the sleeve 162 in a radially outward direction so that the sleeve 162 forms a seal with the inside of the borehole wall (not depicted in FIG. 13). Thus, as depicted in FIGS. 12 and 13 and as described elsewhere in connection with the other disclosed spring sealing mechanisms, a potential advantage of the spring sealing mechanism is that the spring sealing mechanism may be inserted into a borehole that has a minimum hole inner diameter that is smaller than the outer diameter of the spring sealing mechanism in its expanded state. A result of this design is that the spring, once released, will expand against the open hole and through the life of the well, the spring can further expand to maintain sealing if the open hole size increases due to the retained energy in the spring until such time that the open hole size exceeds the maximum outer diameter of the sealing mechanism in its fully expanded state.

Figure 14:
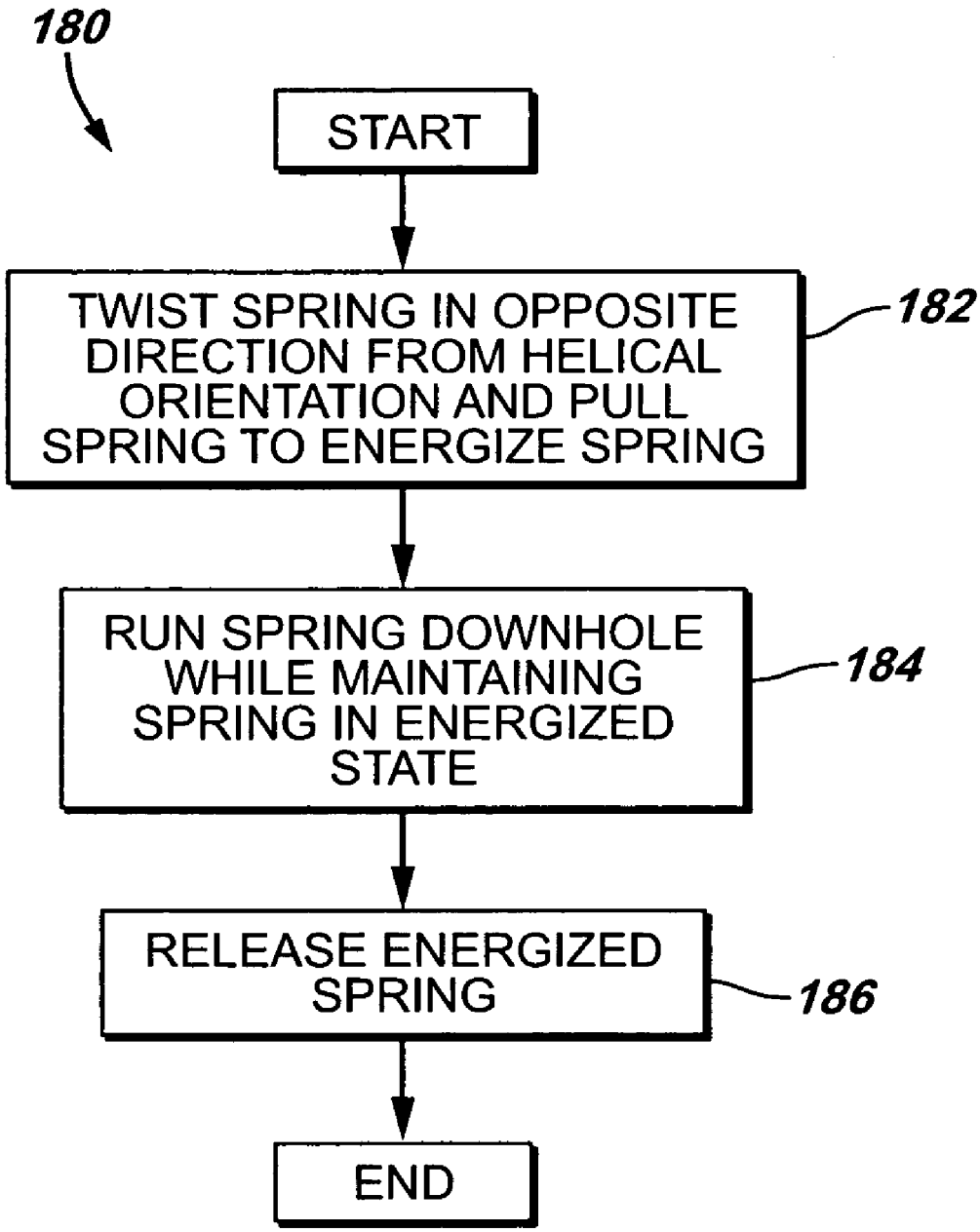

Referring to FIG. 14, in another embodiment of the invention, a technique 180 may be used to deploy an energized spring downhole. More specifically, the technique 180 includes twisting the spring 54 in an opposite direction from its helical orientation and pulling the spring 54 to energize the spring 54, as depicted in block 182. Next, the spring 54 (and thus, the rest of the sealing tool 55) is run downhole while the spring 54 is maintained in its energized state, as depicted in block 184. Subsequently, the energized spring 54 is released when the spring 54 is in the appropriate position downhole, as depicted in block 186.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

The invention claimed is:

1. A method usable with a well, comprising:

deploying a spring downhole;

energizing the spring before running the spring downhole, including twisting the spring to reduce a diameter of the spring while maintaining the spring at the same axial length;

in the well, causing the spring to radially expand using energy stored in the spring and without transferring additional energy to the spring; and wherein the energizing the spring comprises: energizing a coil spring.

2. The method of claim 1, wherein the twisting comprises:

twisting the spring consistent with a helical orientation of the spring.

3. The method of claim 1, wherein the energizing the spring comprises:

twisting the spring from a direction opposite from a direction defined by a helical orientation of the spring.

4. The method of claim 1, further comprising:

providing an elastomer sleeve around the spring.

5. A method usable with a well, comprising:

forming helical groove in a tubular member to form a spring that is used to expand in the subterranean well to form an annular barrier;

downhole in the well, releasing energy stored in the spring to cause the spring to radially expand to form an annular barrier in the well without the spring receiving additional energy to aid the expansion; and longitudinally varying a profile of the tubular member to form the spring.

6. The method of claim 5, wherein the varying comprises: making a wall thickness of the tubular member smaller near a midpoint of the spring than near an end of the spring.

7. The method of claim 5, wherein the varying comprises: varying a winding density of the groove.

8. The method of claim 7, wherein the varying the winding density of the groove comprises: forming a higher density of windings of the groove near a midpoint of the spring than near an end of the spring.

9. An apparatus usable in a well, comprising:

a spring adapted to be energized before being run into the well and in the well release energy stored in the spring to cause the spring to radially expand to form an annular barrier in the well without receiving additional energy to aid the expansion, the spring comprising a tubular member having a helical groove; and wherein a profile of the tubular member varies along a longitudinal length of the spring.

10. The apparatus of claim 9, wherein a thickness of the tubular member is thinner near a midpoint of the spring than near an end of the spring.

11. An apparatus usable in a well, comprising:

a spring adapted to be energized before being run into the well and in the well release energy stored in the spring to cause the spring to radially expand to form an annular barrier in the well without receiving additional energy to aid the expansion, the spring comprising a tubular member having a helical groove; and wherein an angle of the helical groove varies along a length of the spring.

12. The apparatus of claim 11, wherein the tubular member has a higher density of windings of the helical groove near a midpoint of the tubular member than near an end of the tubular member.

13. An apparatus usable in a well, comprising:

a spring adapted to be energized before being run into the well and in the well release energy stored in the spring to cause the spring to radially expand to form an annular barrier in the well without receiving additional energy to aid the expansion, the spring comprising a tubular member having a helical groove; and a sealing sleeve circumscribing the spring.

14. The apparatus of claim 13, wherein the sealing sleeve comprises an elastomer sleeve.

15. A system usable in a subterranean well, comprising:

a string adapted to be run into a wellbore of the well; and a spring adapted to expand to form an annular barrier in the well to seal an annulus of the well, the spring comprising a profile that varies along a longitudinal length of the spring.

16. The system of claim 15, wherein the spring comprises: a tubular member having a helical groove.

17. The system of claim 16, wherein a profile of the tubular member varies along the longitudinal length of the spring.

18. The system of claim 16, wherein a thickness of the tubular member is thinner near a midpoint of the spring than near an end of the spring.

19. The system of claim 16, wherein an angle of the helical groove varies along a length of the spring.

20. The system of claim 16, wherein the tubular member has a higher density of windings of the helical groove near a midpoint of the tubular member than near an end of the tubular member.

21. The apparatus of claim 15, further comprising:

a sealing sleeve circumscribing the spring.

22. The apparatus of claim 21, wherein the sealing sleeve comprises an elastomer sleeve.

23. The apparatus of claim 15, further comprising:

a wedge circumscribed by the spring and adapted to exert a radial force to expand the spring.

24. The apparatus of claim 23, wherein the wedge comprises another spring.

25. The apparatus of claim 24, wherein said another spring comprises a winding that has an opposite orientation than a winding of the first spring.

26. An apparatus usable with a wellbore of a subterranean well, the wellbore having a minimum open hole inner diameter, the apparatus comprising:

a base pipe;

a spring mounted to the base pipe and comprising a profile that varies along a longitudinal length of the spring; and an outer sealing element at least partially surrounding the spring, wherein the sealing element in a relaxed state of the spring has an outer diameter larger than the minimum open hole inner diameter.

27. The apparatus of claim 26, wherein the spring comprises: a tubular member having a helical groove.

28. The apparatus of claim 27, wherein a thickness of the tubular member is thinner near a midpoint of the spring than near an end of the spring.

29. The apparatus of claim 27, wherein an angle of the helical groove varies along a length of the spring.

30. A method usable with a well, comprising:

deploying a spring downhole, the spring having a wall thickness that decreases from a point near the end of the spring to a point near a midpoint of the spring;

energizing the spring; and in the well, releasing energy stored in the spring to cause the spring to radially expand.

31. A method usable with a well, comprising:

deploying a spring downhole;

energizing the spring; and deploying the spring around a wedge whose wall thickness is tapered so that the wall thickness is near a maximum near a midpoint of the wedge.

32. The method of claim 31, further comprising:

deploying a wedge that comprises the spring along a spring.

33. The method of claim 31, further comprising:

providing an elastomer sleeve around the spring.

34. An apparatus usable with a well, comprising:

a spring adapted to expand to form an annular barrier in the well; and a wedge circumscribed by the spring and adapted to exert a radial force to expand the spring, wherein the wedge comprises another spring.

35. The apparatus of claim 34, wherein said another spring comprises a winding that has an opposite orientation than a winding of the first spring.

* * * * *